United States Patent [19]

Eian

[11] 3,935,012

[45] Jan. 27, 1976

[54] PHOTOSENSITIVE SHEET MATERIALS

[75] Inventor: Gilbert L. Eian, White Bear, Minn.

[73] Assignee: Minnesota Mining and Manufacturing Company, St. Paul, Minn.

[22] Filed: July 12, 1973

[21] Appl. No.: 378,526

[52] U.S. Cl. ..... 96/48 R; 96/88; 96/114.1; 428/425

[51] Int. Cl.[2]....G03C 5/24: G03C 1/00; G03C 1/02

[58] Field of Search..... 96/48 R, 48 HD, 88, 114.1; 117/36.8, 36.9; 428/425

[56] References Cited

UNITED STATES PATENTS

| | | | |
|---|---|---|---|
| 3,146,348 | 8/1964 | Workman | 117/36.8 |
| 3,476,562 | 11/1969 | Yamada et al. | 96/88 |
| 3,502,476 | 3/1970 | Itano et al. | 96/90 R |
| 3,533,792 | 10/1970 | Petro | 96/88 |
| 3,544,321 | 12/1970 | Yamada et al. | 96/88 |
| 3,617,288 | 11/1971 | Hartman et al. | 96/88 |
| 3,640,718 | 2/1972 | Smith | 96/48 HD |

*Primary Examiner*—Mary F. Kelley
*Attorney, Agent, or Firm*—Alexander, Sell, Steldt & DeLaHunt

[57] ABSTRACT

Photosensitive sheet material, containing an acid-cleavable adduct of an image-forming first reactant and a reaction inhibitor together with a photolyzable source of halogen acid, which upon exposure to a light-image liberates said first reactant for reaction with a second reactant to produce a visible image, contains a controlled small amount of an acid acceptor for reducing backgrounding and increasing contrast in the resulting print.

13 Claims, 1 Drawing Figure

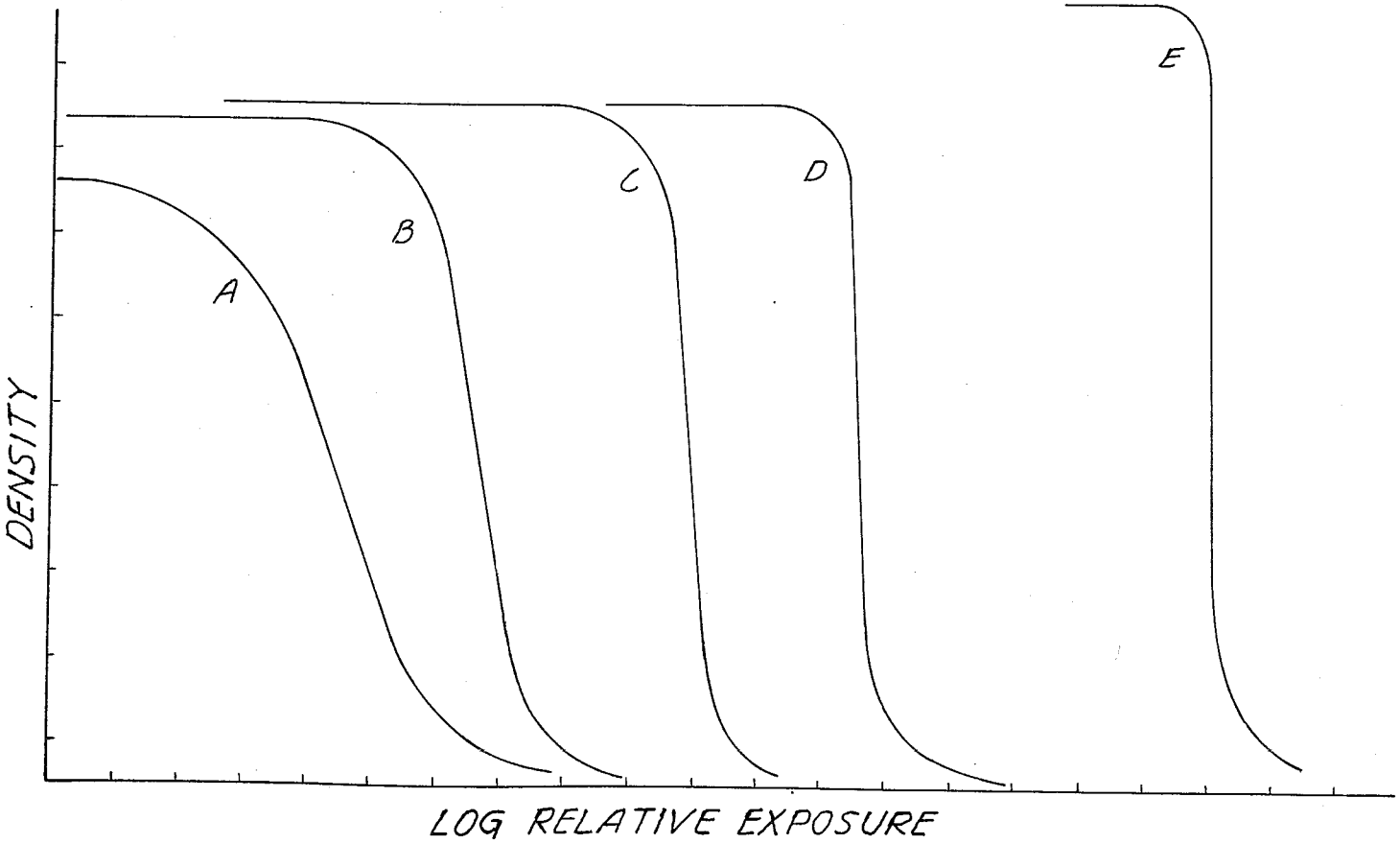
DENSITY
A
B
C
D
E
LOG RELATIVE EXPOSURE

PHOTOSENSITIVE SHEET MATERIALS

This invention relates to the recording of lightimages and to sheet materials useful therein. More specifically, the invention relates to sheet materials having a light-sensitive layer which on exposure to a light-image liberates a first reactant material, which first reactant then causes a visible change to occur in a companion sheet or layer by interaction with a second reactant material contained therein. In one aspect the invention relates to light-sensitive intermediate sheet materials containing a light-sensitive source of hydrogen halide together with an acid-cleavable adduct of a first reactant material and a reaction inhibitor therefore, and in which sheet is contained a controlled small amount of an acid acceptor. In another aspect the invention relates to the interaction of the light-sensitive intermediate sheet, after exposure to a light-image, with a receptor or print sheet or layer containing a second reactant, to produce on the latter sheet well-defined corresponding or inverse high contrast image and background areas.

The improvement in contrast obtained by the practice of the invention may frequently be illustrated in terms of the increase in gamma as derived from the characteristic, or D log E, curves of sensitometric data, as will be shown hereinafter in more detail. As but one illustration of utility, the invention has made possible the preparation, by a process involving reflex exposure of the light-sensitive sheet in contact with a printed original, of color projection transparencies which project reverse or negative copy having white images and intensely colored backgrounds.

Light-sensitive systems which contain organic halogen compounds and which readily yield hydrogen halide on exposure to light are well known. The use of sensitizers to broaden the spectral response of such systems is also known. A particularly desirable class of sensitizers has been described in U.S. Pat. No. 3,640,718, which also describes the use of the sensitized organic halogen compounds in imaging systems. In one such system the hydrogen halide acts to liberate a reactive naphthol from its acid-cleavable normally non-reactive adduct. Reaction of the liberated naphthol with a co-reactant, as for instance a silver salt, then provides a visible change.

It has now been found possible to obtain significant improvement in the prints made with these and other analogous imaging systems involving acid cleavage of an adduct, by incorporating in the light-sensitive sheet controlled small amounts of acid acceptors, sufficient only to retain substantially less than all of the hydrogen halide made available upon exposure to light. The characteristic curve obtained with the product is not merely displaced along the exposure axis but is steepened, thereby showing an increased gamma value; and the resulting print shows increased contrast. In some instances systems which normally undergo such intense backgrounding as to produce no visible distinction between exposed and unexposed areas are enabled to yield well-defined prints showing substantially no backgrounding.

Although useful acid acceptor materials may be either organic or inorganic, certain classes of organic basic-nitrogen compounds are found to be particularly effective and are presently preferred. These materials are not oxidized by any agents produced in the coatings by photolysis. Their conjugate acids have pKa values of at least 3.3. The acid acceptors contain no hydrogen-heteroatom bonds with dissociation energies less than 85 kilocalories/mole unless the pKa value of the conjugate acid is at least 4.6.

Photolyzable organic halogen compounds are known to dissociate upon exposure to actinic radiation, to yield halogen free radicals. These free radicals are good hydrogen abstractors and in presence of hydrogen donors will form hydrogen halide. Suitable hydrogen donors are invariably present in the compositions and coatings of this invention, e.g., as the adduct, as the film-forming binder, as residual traces of organic solvent, or as the organic halogen compound itself; and exposure to light of coatings containing these materials in conjunction with the organic halogen compounds therefore results in formation of hydrogen halide.

Photolyzable organic halogen compounds which have been found useful in these constructions include hexabromoethane, tris(tribromomethyl)-s-triazine, and particularly the ester and urethane derivatives of tribromoethanol such as 2,2,2-tribromoethyl-benzoate, -2-furoate, -3-chlorobenzoate, -3,4-dichlorobenzoate, -2,4-dichlorobenzoate, -1-naphthoate, -2-naphthoate, -N-phenylcarbamate, which derivative materials provide improved thermal stability. The -4-nitrobenzoate and -3,5-dinitrobenzoate derivatives photolyze too slowly to be commercially acceptable, whereas the benzenesulfonate derivative is thermally unstable; and such classes of compounds are therefore to be excluded for purposes of the present invention.

The print sheet or layer suitable for forming a black image on a white background, as described in U.S. Pat. No. 3,640,718, contains as the second reactant a reducible metal salt, e.g., a silver salt, together with a hindered phenol reducing agent and a toner for the silver image. Reduction of a portion of the silver salt to the metal by reaction with a reducing agent obtained from light-struck areas of the intermediate sheet or layer then catalyzes the heat-induced reduction of the remaining silver salt by the less reactive hindered phenol to form the visible image.

Reducing agents such as 4-methoxy-1-naphthol and hydroquinone are useful as co-reactants for such silver salt coatings. These same reducing agents are likewise found useful as co-reactants for reducible dyes, such for example as N,N-diethyl-2-chloro-2′-methylindoaniline or sodium 2,3′,6-trichloro-indophenol, causing decolorization of the dye. Furthermore, these organic reducing agents readily combine with suitable reaction inhibitors, notably the dihydropyrans, to form acid-cleavable adducts which no longer act as reducing agents for the silver salt or the reducible dye. Many of the reducing agents, which are stable solids at normal room temperatures, are readily volatilizable at moderately elevated temperatures of the order of 130° C., and accordingly are easily transferred in vapor form from the intermediate sheet to a superposed print sheet. Thus, a preferred class of first reactants for the practice of the invention may be identified as reducing agents for silver. Other classes of reactants which undergo or cause a visible change on reaction with a co-reactant and which form an acid-cleavable adduct are useful in other systems.

Reaction-inhibited acid-cleavable adducts of these reducing agents for silver may be formed with a wide variety of organic compounds containing vinyl ether linkages, including compounds of such classes as the alkyl vinyl ethers, the dihydropyrans, and polyvinyl compounds such as glycoldivinyl ethers and glyceroltrivinyl ethers. For a variety of reasons, adducts of the dihydropyrans are preferred in the practice of this invention.

Exact stoichiometric relationships between adduct, photolyzable source of hydrogen halide, and acid acceptor are difficult if not impossible to determine. Thus, the several halogens of compounds such as hexabromoethane and tris(tribromomethyl-s-triazine photolyze at greatly different rates or under widely diverse conditions, so that the amount of hydrogen halide available on exposure to a light-image cannot be accurately estimated. Furthermore, the cleavage of the adduct by the hydrogen halide appears to proceed by a catalytic rather than a stoichiometric route, so that the amount of acid required to release the reducing agent cannot be ascertained with accuracy. In general, the amount of adduct must be sufficient to provide a concentration of reducing agent which will, on reaction with the reactant of the print sheet or layer, form or catalyze a distinctly visible change. The amount of photolyzable material must then be sufficient to produce an amount of hydrogen halide sufficient to cause cleavage of the adduct. And the amount of acid acceptor must be sufficient to remove all or substantially all of any hydrogen halide released in the unexposed or partially exposed areas but insufficient to remove the excess over such amounts which may be liberated at the fully exposed areas, thereby to cause a distinct difference in appearance between image and background areas of the developed print, generally observable as an improvement in contrast. As a general rule, the amount of acid acceptor required will be well within the range of 0.01 to 2.0 moles per mole of organic halogen compound, and usually within the preferred narrower range of 0.3 to 1.2 moles.

Differences in optical contrast may be estimated visually but are more accurately determined by sensitometric measurements, an increase in contrast being represented as an increase in gamma. Typically, the light-sensitive sheet containing the photosensitive organic halogen compound and the acid-cleavable reactant adduct, together with the acid acceptor when present, is exposed through an optical step wedge and is then heated against a suitable receptor sheet to develop a corresponding sequence of images. The optical density of the images is then measured and plotted against the relative exposure on a logarithmic scale, the slope of the curve representing the gamma or contrast value. An indication of relative photographic speed may simultaneously be obtained if the exposure is controlled to provide minimum recognizable exposure at the same point on the wedge in each instance. The accompanying drawing presents a series of D log E curves obtained in this manner as will be further described hereinafter.

The following Examples are provided further to illustrate but not to limit the invention. Proportions are given in parts by weight unless otherwise indicated.

EXAMPLE 1

A coating composition is prepared containing:

| | |
|---|---|
| binder (cellulose acetate butyrate) | 2.8 |
| solvent (methylethyl ketone) | 47.1 |
| (1,2-dichloroethane) | 6.6 |
| adduct of tertiarybutyl hydroquinone | 1.0 |
| tris-(tribromomethyl)-s-triazine | 0.5 |
| spectral sensitizer | 0.025 |

One-tenth of the composition is coated as control coating A. To other tenth-parts are added different amounts of piperazine as acid acceptor, these mixtures providing coating B-E. The coatings are applied to clear polyester film from a 3.0 mil (0.075 mm.) coating orifice and permitted to dry, all operations being conducted in the dark or under an appropriate safelight, to provide a series of photosensitive intermediates.

The adduct is prepared from 1:2 molar proportions of t-butyl hydroquinone and dihydropyran by combining under anhydrous conditions in the presence of catalytic amounts of strong acid.

The spectral sensitizer is the dibutyl ether of the leuco form of Vat Violet 7 (C.I. 59320).

Separately, a receptor sheet is prepared by coating clear polyester film from a 3.0 mil (0.075 mm.) orifice with a solution containing,

| | |
|---|---|
| ethyl cellulose | 0.5 |
| acetone | 9.5 |
| n-butyl alcohol | 0.5 |
| reducible dye | 0.025 |

and drying. The dye is N,N-diethyl-2-chloro-2′-methylindoaniline. The sheet is an intense blue color.

Segments of the intermediates are exposed to light from a high intensity tungsten filament source through a log $\sqrt{2}$ step wedge for the time indicated in the following tabulation, and then placed against the receptor sheet and heated at 130° C. for 5 seconds. Exposure time is selected to assure that the full range of density variation is obtained in the print.

| Sample | Piperazine | Ratio | Exposure | Gamma |
|---|---|---|---|---|
| A | 0 | 0 | 15 sec. | 1.4 |
| B | 0.0005 | 0.097 | 15 sec. | 2.9 |
| C | 0.002 | 0.39 | 60 sec. | 5.8 |
| D | 0.003 | 0.580 | 120 sec. | 9.9 |
| E | 0.006 | 1.16 | 480 sec. | 10.0 |

The ratio expressed is the number of moles of piperazine per mole of tris-(tribromomethyl)-s-triazine.

The results are further indicated in the drawing, showing the characteristic curves (density vs. relative log exposure curves) of Samples A–E. The negative slope of the curves is a result of the reversal process employed in going from the light-sensitive intermediate to the final print sheet, and is disregarded in the tabulations of gamma values herein provided.

EXAMPLE 2

A large number of acid acceptors is tested in a separate series, using formulations and under procedures essentially as described in Example 1 except that the concentration of tris-(tribromomethyl)-s-triazine is increased to 0.6 part on the same formula basis and 0.030 part of perylene replaces the 0.025 part of butylated Vat Violet 7 as spectral sensitizer.

The coated films, containing the various acid acceptor compounds in the amounts indicated in place of the piperazine as used in the photosensitive intermediate sheets of Example 1, are exposed through the step wedge and heated against the blue receptor sheet all as previously described. The results in terms of resultant gamma values are shown in the following tabulation, which additionally sets forth the parts by weight of the acid acceptor and the pKa of its conjugate acid in each case.

| acid acceptor | pKa | parts | gamma |
|---|---|---|---|
| none (control) | — | — | 1.5 |
| 1,8-bis(dimethylamino) naphthalene | 12.3 | .005 | 3.0 |
| piperidine | 11.2 | .005 | 5.1 |
| diethylamine | 11.0 | .008 | 3.4 |
| 1,12-diaminododecane | ca 11 | .005 | 4.1 |
| 1,10-diaminodecane | ca 11 | .005 | 4.9 |
| 1,8-diaminooctane | 11.0 | .005 | 3.5 |
| polyethyleneimine | ca 10.6 | .005 | 3.0 |
| triethylamine | 10.6 | .003 | 2.9 |
| 1,3-diaminopropane | 10.6 | .005 | 5.6 |
| 1,3-diphenylguanidine | 10.2 | .005 | 3.7 |
| ethylenediamine | 10.0 | .010 | 5.8 |
| piperazine | 9.8 | .005 | 5.9 |
| 1,3-diamino-2-propanol | 9.7 | .005 | 5.8 |
| 2-aminoethanol | 9.5 | .010 | 2.5 |
| benzylamine | 9.4 | .005 | 4.2 |
| 4-aminopyridine | 9.2 | .005 | 5.2 |
| morpholine | 8.4 | .005 | 3.9 |
| triallylamine | 8.3 | .005 | 5.3 |
| methylhydrazine | 7.9 | .005 | 2.7 |
| triethanolamine | 7.8 | .005 | 5.3 |
| imidazole | 7.0 | .003 | 4.3 |
| N,N-diethylaniline | 6.6 | .003 | 4.5 |
| 4-methylpyridine | 6.0 | .005 | 3.2 |
| 3-aminopyridine | 6.0 | .006 | 5.1 |
| 2-methylpyridine | 6.0 | .005 | 3.0 |
| N,N-diethyl-o-toluidine | 5.9 | .005 | 4.8 |
| 2-t-butylpyridine | 5.8 | .005 | 4.7 |
| 3-methylpyridine | 5.7 | .006 | 4.1 |
| benzimidazole | 5.5 | .005 | 4.8 |
| 4-aminophenol | 5.5 | .005 | 2.5 |
| isoquinoline | 5.4 | .005 | 5.1 |
| pyridine | 5.3 | .005 | 5.3 |
| 4-anisidine | 5.3 | .005 | 2.5 |
| 5-hydroxyquinoline | 5.2 | .005 | 4.7 |
| 6-hydroxyquinoline | 5.2 | .005 | 4.7 |
| 8-hydroxyquinoline | 5.1 | .005 | 2.7 |
| 4-toluidine | 5.1 | .005 | 2.3 |
| quinoline | 4.9 | .005 | 3.9 |
| 3-fluoropyridine | 4.8 | .005 | 2.5 |
| N-methylaniline | 4.8 | .005 | 3.3 |
| 2-aminophenol | 4.7 | .005 | 2.3 |
| trimethylamine oxide | 4.7 | .010 | 4.8 |
| 3-toluidine | 4.7 | .005 | 2.6 |
| N,N-diethyl-4-nitroso-aniline | 3.5 | .007 | 3.8 |
| phthalazine | 3.5 | .003 | 3.7 |
| 4-hydroxypyridine | 3.3 | .003 | 4.0 |

EXAMPLE 3

The stock solution contains:

| | |
|---|---|
| polypropylene oxide | 0.5 |
| chloroform | 9.5 |
| adduct of 4-methoxy-1-naphthol | 0.2 |
| methyl-bis(trichloromethyl)-s-triazine | 0.04 |
| bis-(4-dimethylamino-benzalacetone | 0.008 |

The adduct is prepared from 4-methoxy-1-naphthol and dihydropyran in equimolar proportions.

One-half of the solution is coated at 3 mils (0.075 mm.) on polyester film as a control.

To the other one-half is added:

1,8-bis(dimethylamino)-naphthalene 0.003 as acid acceptor, and this solution is similarly coated.

After drying, the two films are exposed through a step wedge and heated against a blue receptor film prepared by coating polyester film with 3 mils (0.075 mm.) of a solution prepared by dissolving 0.025 part of the sodium salt of 2,3′,6-trichloroindophenol in 10 parts of a 5% solution of hydroxypropyl cellulose in methanol, and drying. The following gamma values are obtained:

| sample | gamma |
|---|---|
| control | 1.6 |
| with acid acceptor | 2.8 |

Copies of printed graphic originals are prepared by exposure of the intermediate sheets in contact with the original, i.e., by reflex exposure, followed by heating the exposed intermediate against the receptor sheet. The copy made with the sheet containing the acid acceptor is visibly better in contrast than is the copy made with the control sheet.

EXAMPLE 4

Using the same techniques as previously described, an intermediate sheet containing the adduct of two moles of dihydropyran and one mole of hydroquinone as the source of reducing agent, cellulose acetate butyrate as the binder, and hexabromoethane as the photosensitive halogen compound is compared with an otherwise identical sheet containing an acid acceptor of the same kind and in the same amount as in Example 3. The exposed sheets are heated in contact with a print film containing four parts of the blue-green (cyan) dye N,N-diethyl-2,6-dichloro-2′-methylindoaniline in 50 parts of ethyl cellulose. Contrast is improved by incorporation of the acid acceptor, the gamma value being increased from 1.5 for the control to 3.5 for the improved sheet.

EXAMPLE 5

An intermediate sheet containing 24.4 parts binder, 4.75 parts anhydrous potassium carbonate, 10 parts dihydropyran adduct of t-butylhydroquinone, 6 parts of tris-(tribromomethyl)-s-triazine, and 0.3 parts perylene is compared with an otherwise identical sheet from which the potassium carbonate is omitted, by exposure through a step wedge and heating against a blue film as described under Example 2. Contrast of prints obtained with the sheet containing the potassium carbonate is markedly greater than of those obtained with the control sheet.

EXAMPLE 6

A stock solution for the intermediate sheet coating is prepared as in Example 2 except that the methoxynaphthol adduct of Example 3 replaces the adduct of t-butylhydroquinone. Portions with and without acid acceptors are coated, the dried sheets are exposed through the step wedge at exposures selected to indicate sensitivity, and the exposed samples are then heated against a transparent receptor sheet containing a silver salt, a hindered phenol reducing agent, and a toning agent and available from Minnesota Mining and Manufacturing Company as Type 659 Transparency. Results are as here tabulated:

| acid acceptor | mole ratio | exposed | gamma |
|---|---|---|---|
| none (control) | 0 | 5 sec. | 1.4 |
| 1,8-bis(dimethylamino)-naphthalene | 0.31 | 30 | 5.9 |
| 1,12-diaminododecane | 0.34 | 60 | 6.5 |
| imidazole | 1.0 | 60 | 8.3 |
| N,N-diethylaniline | 0.47 | 30 | 6.6 |
| piperazine | 0.8 | 120 | 4.9 |

EXAMPLE 7

Intermediate sheets are prepared by coating polyester film with compositions containing:

| | |
|---|---|
| cellulose acetate butyrate | 3.1 |
| methyl ethyl ketone | 48 |
| 1,2-dichloroethane | 2.4 |
| adduct of phenothiazine and dihydropyran | 1.0 |
| tris(tribromomethyl)-s-triazine | 0.6 |
| acid acceptor | 0.01 |

The sheets are exposed through a step wedge and heated against a Type 659 silver salt receptor sheet as in Example 6. Results are shown in the accompanying table

| acid acceptor | exposure, sec. | gamma |
|---|---|---|
| 1,8-bis(dimethylamino) naphthalene | 30 | 6.6 |
| piperidine | 5 | 7.2 |
| 1,12-diaminododecane | 2 | 5.6 |

A control example containing no acid acceptor is found to cause complete darkening of the receptor sheet.

EXAMPLE 8

Each of the intermediate sheets of the foregoing examples contains a spectral sensitizer for the photosensitive organic halogen compound, and is therefore capable of activation by visible light as obtained from an incandescent tungsten filament. In the absence of the sensitizer it is found necessary to employ a different light source.

A control intermediate sheet is prepared using a coating solution containing:

| | |
|---|---|
| cellulose acetate butyrate | 0.50 |
| solvent | 10.0 |
| bis-tetrahydropyranyl ether of t-butyl hydroquinone | 0.15 |
| tris-(tribromoethyl)-s-triazine | 0.40 |

A second intermediate sheet is similarly prepared but with the addition to the solution of 0.006 part of 1,8-bis-(dimethylamino)-naphthalene.

The two are exposed through a step wedge to light from a mercury arc source ("Colight MUV-1026") for times selected to indicate sensitivity and are then heated against a blue receptor film containing N,N-diethyl-2-chloro-2'-methyl-indoaniline to cause bleaching at areas corresponding to the exposed areas. Results are as follows:

| sample | exposure | gamma |
|---|---|---|
| control | 5 minutes | 3.0 |
| with acid acceptor | 10 | 4.4 |

EXAMPLE 9

An intermediate having a coating containing:

| | |
|---|---|
| polypropylene oxide | 0.5 |
| adduct of dihydropyran and 4-methoxy-1-naphthol | 0.2 |
| methyl-bis-(trichloromethyl)-s-triazine | 0.04 |
| bis-(4-dimethylamino)-benzalacetone | 0.008 |
| 1,8-bis(dimethylamino)-naphthalene | 0.006 |

is exposed through a stencil and heated against a receptor sheet having a sub-coating of benzimidazole in vinyl chloride-vinyl acetate ("VYNS") copolymer as the binder and a top-coating of acid-stabilized diazonium salt (Andrews "54S" diazo) in ethyl cellulose binder. The areas of the receptor sheet corresponding to the light-struck areas of the intermediate develop a blue color. The non-exposed areas remain colorless.

EXAMPLE 10

A difunctional dihydropyran is prepared by reacting together equimolar quantities of 3,4-dihydro-2H-pyran-2-methanol and tolylene-2,4-diisocyanate in benzene using a small amount of triethylenediamine as catalyst. The bisdihydropyran product is converted to a polymeric tetrahydropyranyl ether (adduct) by reaction with tert-butyl hydroquinone in 1:1 molar ratio in benzene, using p-toluenesulfonic acid as catalyst.

Light-sensitive intermediate sheets are prepared with the polymeric ether adduct and both with and without an acid acceptor, the dried coatings having the following composition:

| | |
|---|---|
| cellulose acetate butyrate | 31.4 |
| polymeric adduct | 8 |
| hexabromoethane | 5 |
| butylated vat violet 7 | 0.3 |
| (1,8-bis(dimethylamino)naphthalene | 0.5) |

The sheets are exposed through a step wedge and corresponding images are developed by heating the exposed strips against a blue receptor sheet containing the reducible dye N,N-diethyl-2-chloro-2'-methylindoaniline and formulated as described in Example 1. The addition of the small amount of 1,8-bis(dimethylamino)naphthalene is found to impart improved contrast. In the absence of this compound, the blue areas of the developed receptor sheet show lowered color intensity.

EXAMPLE 11

Replacing the polymeric adduct of Example 10 with an equal amount of the 1:1 adduct of tert-butyl hydroquinone and tert-butyl vinyl ether results in complete decolorization of the receptor sheet by the control sheet when the two are heated together either with or without previous exposure. On the contrary, heating the exposed intermediate containing the acid acceptor against the receptor sheet produces a high contrast image on a blue background.

EXAMPLE 12

A transparent intermediate is prepared by application to a transparent polyester film of a coating containing:

| | |
|---|---|
| cellulose acetate butyrate | 137.5 |
| dihydropyran adduct of t-butyl hydroquinone | 42.6 |
| 2,2,2-tribromoethyl-2,4-dichlorobenzoate | 12.5 |
| sensitizer (butylated vat violet 7) | 1.5 |
| inert filler (cationic starch-optional) | 1.0 |
| 1,8-bis(dimethylamino)-naphthalene | 0.6 |

applied from solution in

| | |
|---|---|
| methyl ethyl ketone | 2360 |

at a coating orifice of 3 mils (0.075 mm.) and dried.

The intermediate is placed against a graphic original printed in black ink on white paper, and the original is exposed through the intermediate. The latter is then heated against a receptor sheet coated with a composition containing:

| | |
|---|---|
| ethyl cellulose | 50 |
| N,N,-diethyl-2-chloro-2'-methylindoaniline | 2.5 |

prepared as in Example 1.

The areas corresponding to the background areas of the original are rendered colorless, while the areas corresponding to the printed characters of the original retain their clear blue color. The copy serves as an excellent color projection transparency, the projected image appearing in intense blue characters against a white background.

Omission of the 1,8-bis(dimethylamino)naphthalene acid acceptor from the formula of the intermediate sheet results in extreme backgrounding in the copy and loss of contrast on the projection screen.

EXAMPLE 13

A coating composition containing

| | |
|---|---|
| methyl ethyl ketone | 2350 |
| cellulose acetate butyrate | 150 |
| 1:1 adduct of dihydropyran and 4-methoxy-1-naphthol | 12 |
| (2,2,2-tribromoethyl)-2,4-dichlorobenzoate | 9.6 |
| butylated Vat Violet 7 | 0.84 |
| diphenyl guanidine | 0.42 |

is applied to polyester film as a thin uniform coating and dried. The dry coating weighs 0.21 gram/sq. ft. (2.1 g./sq.m.)

The resulting intermediate sheet is placed in reflex position against a printed original having black indicia on a white background and the printed surface is exposed through the intermediate for 18 seconds to light from a bank of incandescent filament lamps.

The sheet is then placed in face-to-face contact with a transparent receptor sheet having a coating containing a silver soap, a hindered phenol reducing agent, and a toning agent ("Type 659" Transparency) and the composite is heated by repeated passes through a hot roll heating device sufficient to develop a dense black appearance at areas corresponding to the unprinted areas of the original. Areas corresponding to the black printed areas of the original remain clear and transparent. Intermediate areas are likewise faithfully inversely reproduced. As many as 90–100 lines per inch are faithfully copied. The print serves as a highly effective projection transparency.

The above examples have for convenience been described in terms of separate intermediate and print sheets, and image development by heating. Sheet materials having separate layers on a single backing, for example with a silver salt coating beneath a light-sensitive coating, as well as transfer of reactant by solvent transfer or in other ways, are also contemplated as being within the ambit of the invention. Combinations of reactants may be used, and other non-inventive variations as will become apparent in the light of the foregoing description are likewise contemplated.

What is claimed is as follows:

1. Light-sensitive sheet material useful as an intermediate in forming a record of a light-image on a print sheet containing a second reactant which is reactive with a first reactant to provide a visible change; said intermediate sheet consisting essentially of a photolyzable heat-stable source of hydrogen halide, an acid-cleavable adduct of a said first reactant and an organic compound containing a vinyl ether linkage, said adduct being capable of supplying a reducing agent when cleaved with acid, and an acid acceptor for said hydrogen halide in an amount, between 0.01 and 2.0 moles per mole of said photolyzable source, less than sufficient to retain all of the hydrogen halide available from said photolyzable source upon exposure to said light image; wherein said acid acceptor is selected from the group consisting of:

a. nitrogen-containing organic compounds having at least one basic group and wherein the conjugate acid corresponding to each said group has a pKa value greater than 4.6, and b. nitrogen-containing organic compounds having at least one basic group, wherein the conjugate acid corresponding to each said group has a pKa value greater than 3.3, and wherein said compound has no hydrogen-heteroatom bond with dissociation energy less than 85 kcal/mole.

2. Sheet material of claim 1 wherein said acid acceptor is a 1,8-bis(dimethylamino)-naphthalene.

3. Sheet material of claim 1 wherein said acid acceptor is diphenyl guanidine.

4. Sheet material of claim 1 wherein said first reactant is a phenolic reducing agent for silver.

5. Sheet material of claim 4 wherein said reducing agent is volatilizable at 130° C.

6. Sheet material of claim 1 wherein said organic compound containing a vinyl ether linkage is a 3,4-dihydropyran.

7. Sheet material of claim 6 wherein said first reactant is a phenolic reducing agent for silver.

8. Method of making a high contrast record of a light-image comprising: exposing to said light-image an intermediate sheet of claim 1 to cause liberation of hydrogen halide, cleavage of said adduct, and release of a reducing agent at light-exposed areas; and then inducing reaction of said reducing agent with a second reactant in a companion print sheet or layer, which is in contact with said intermediate sheet, to cause in said print sheet or layer a visible change at image-defining areas.

9. Method of claim 8 wherein said second reactant is a metal salt reducible to metal by reaction with said first reactant.

10. Method of claim 8 wherein said second reactant is a dye which is reducible to a less colored lueco form by reaction with said first reactant.

11. Method of claim 8 wherein said reactant is photolyzable at 130° C. and said reaction is induced by heating said intermediate sheet against a said print sheet.

12. Sheet material of claim 1 wherein said photolyzable source is an ester or urethane derivative of tribromoethanol.

13. Light-sensitive sheet material resistant to thermally induced degradation and containing as a photolyzable source of halogen free radicals an ester or urethane derivative or tribromoethanol.

* * * * *